United States Patent [19]

Zagoroff

[11] Patent Number: 4,559,795

[45] Date of Patent: Dec. 24, 1985

[54] PASSIVE ANTI-THEFT DEVICE FOR VEHICLE IGNITION LOCK

[76] Inventor: Dimiter S. Zagoroff, 10 Hilliard Pl., Cambridge, Mass. 02138

[21] Appl. No.: 502,668

[22] Filed: Jun. 9, 1983

[51] Int. Cl.[4] ..... E05B 15/16; E05B 63/00

[52] U.S. Cl. ..... 70/422; 70/252

[58] Field of Search ..... 70/1.5, 1.7, 165, 221, 70/224, 252, 416–418, 422; 292/352, 353

[56] References Cited

U.S. PATENT DOCUMENTS

| | | | |
|---|---|---|---|
| D. 227,547 | 7/1973 | Bodan | D8/113 |
| 1,289,867 | 12/1918 | Moore | 292/353 X |
| 1,516,152 | 11/1924 | Dumont | 70/422 X |
| 2,059,695 | 11/1936 | Jacobi | 70/224 X |
| 2,098,736 | 11/1937 | Bannon et al. | 192/13 |
| 2,225,703 | 12/1940 | Machinist | 70/417 |
| 2,766,605 | 10/1956 | O'Brien | 70/8 |
| 3,083,563 | 4/1963 | Greenwald | 70/417 |
| 3,434,752 | 3/1969 | Russell et al. | 292/352 X |
| 3,552,518 | 1/1971 | Aidner | 180/114 |
| 3,665,738 | 5/1972 | Pescuma et al. | 70/211 |
| 3,722,243 | 3/1973 | Schiesterl | 70/369 |
| 3,811,303 | 5/1974 | Robertson | 70/327 |
| 3,916,568 | 11/1975 | Barry | 70/417 |
| 4,020,662 | 5/1977 | Fowler | 70/237 |
| 4,052,869 | 10/1977 | Weber | 70/252 |
| 4,056,955 | 11/1977 | Glass | 70/422 |
| 4,167,222 | 9/1979 | El Bindari | 180/287 |
| 4,207,850 | 6/1980 | Wharton | 123/146.5 B |
| 4,222,253 | 9/1980 | Peitsmeier | 70/417 |
| 4,342,478 | 8/1982 | Foshee | 292/352 |
| 4,394,821 | 7/1983 | Best et al. | 70/422 |

*Primary Examiner*—Kenneth J. Dorner
*Assistant Examiner*—Russell W. Illich

[57] ABSTRACT

An improved protective device for an ignition lock cylinder of a motorized vehicle comprising an armored cap arranged axially with and covering the cylinder end, the cylinder and cap adapted for mutual rotation about the cylinder axis to activate the ignition when a mating key is inserted through the cap to unlock the cylinder, the cap adapted to be rotated by hand to rotate the cylinder. The improvement comprises a torque-sensitive coupling adapted to be disposed in coupling relationship between the lock cylinder and cap. The coupling is constructed and arranged to transmit torque applied to the cap cylinder of a value below a predetermined maximum value selected to exceed normal torque applied to an unlocked cylinder by hand action of a vehicle operator. The maximum torque value is less than that needed to force rotation of the cylinder when the cylinder is still locked. The coupling is also adapted to disengage between the cap and cylinder when torque above the predetermined maximum value is applied.

Whereby the cap and cylinder are positively related to prevent independent rotation of either during normal operation, e.g. to avoid damage to a key that has been only partially inserted into said cylinder, the cap being free to turn in uncoupled relationship with the cylinder when abnormal torque is applied to the cap, thereby to prevent rotation of the cylinder by force of a car thief. In another aspect, a device for aligning the cap and cylinder coaxially is provided, e.g. where a protective coupling is also employed.

7 Claims, 11 Drawing Figures

PASSIVE ANTI-THEFT DEVICE FOR VEHICLE IGNITION LOCK

BACKGROUND OF THE INVENTION

This invention relates to passive anti-theft devices for vehicle ignition locks.

Vehicle manufacturers have built a number of anti-theft features into the ignition locks of cars and trucks. When the key is taken out, the steering wheel is locked from turning and the gear shift lever is prevented from moving. So, theoretically, it's impossible to drive the car. The Achilles heel of this approach has been that it is relatively easy for an auto thief to pull out the cylinder of the ignition lock and bypass these measures.

To circumvent this problem it has been suggested, e.g. in U.S. Pat. Nos. 3,916,658 and 4,167,222, to surround the steering lock with a hardened metal casing while providing key access to the rotating lock cylinder by mounting a hardened rotatable cap with a slot that permits insertion of the key to turn the lock, yet guards against pulling the lock cylinder out.

One particularly bothersome problem of this approach is that if the operator does not insert the key fully, but then attempts to turn on the ignition by turning the cap, the portion of the key that is captured in the slot tends to turn with the cap while the portion that is captured in the lock cannot turn. Because of the mechanical advantage provided by the relatively large cap, the key is either bent or broken.

One object of this invention is to prevent such key breakage.

A further problem is providing and maintaining proper alignment of the key access through the armor cap with the rotating lock cylinder. If the access is not aligned, or if it slips out of alignment, the lock cylinder can jam during operation with resulting damage to the vehicle, e.g. a burned out starter motor.

A further object of the invention is to prevent such misalignment.

SUMMARY OF THE INVENTION

The invention relates to a protective device for an ignition lock cylinder of a motorized vehicle comprising an armored cap arranged axially with and covering the end of the cylinder, the cylinder and cap adapted for mutual rotation about the axis of the cylinder to activate the vehicle ignition when a mating key is inserted through the cap to unlock the cylinder, the cap adapted to be rotated by hand to rotate the cylinder.

According to the invention, a torque-sensitive coupling means is adapted to be disposed in coupling relationship between the lock cylinder and the cap, the coupling means constructed and arranged to transmit torque applied to the cap cylinder of a value below a predetermined maximum value selected to exceed normal torque applied to an unlocked cylinder by hand action of a vehicle operator, the maximum torque value being less than that needed to force rotation of the cylinder when the cylinder is still locked, the coupling means being adapted to disengage between the cap and the cylinder when torque above the predetermined maximum value is applied to the cap, whereby the cap and the cylinder are positively related to prevent independent rotation of either during normal operation, e.g. to avoid damage to a key that has been only partially inserted into the cylinder, the cap being free to turn in uncoupled relationship with the cylinder when abnormal torque is applied to the cap, thereby to prevent rotation of the cylinder by force of a car thief.

In preferred embodiments, the coupling means is a member having a protuberance, and a surface of the cap defines a complementary protuberance, the corresponding protuberances being engaged to provide coupled rotation during normal operation, and during application of torque in excess of the predetermined maximum value the protuberances being adapted to disengage thereby to permit relative motion between the coupling and the cap, preferably the coupling means is adapted to deform about the protuberance under torque exceeding the maximum value to disengage the coupling means from the cap.

According to another aspect, the invention further includes the coupling means comprising a substantially annular member, the surface of the member defining at least two radially extending protuberances, at least one radial protuberance comprising a detent, and the surface of the cap defining an annular groove configured and adapted to receive and confine the detent, at least one other radial protuberance comprising an axially aligned ridge and the surface of the cap further defining a complementary protuberance, the complementary protuberance of the coupling means adapted to couple with the complementary protuberance of the cap to couple the lock cylinder to the cap for transmission of the applied torque to the maximum value and to disengage when torque above that value is applied.

In another aspect, the invention relates to a device further including means providing a bearing surface for said cap.

According to this aspect, the invention further includes an alignment means for fixedly aligning and maintaining the coaxial relationship of the cap and the cylinder.

In still another aspect, the invention relates to a device further including means providing a bearing surface for the cap, and a protective cowl constructed and arranged to be disposed about a housing containing the ignition lock cylinder to prevent unauthorized access thereto by car thieves.

According to this aspect of the invention, the protective cowl comprises a conical protrusion extending about the housing and terminating in the rotatable cap bearing surface adjacent the end of said cylinder.

In preferred embodiments of this aspect of the invention, the conical protrusion is an integral portion of at least a part of the protective cowl disposed about the housing, and the device further comprises alignment means for fixedly aligning and maintaining the coaxial relationship of the cylinder and the cap, the alignment means being constructed and arranged to position the bearing surface in a coaxial relationship with the cylinder.

PREFERRED EMBODIMENT

I turn now to a presently preferred embodiment of the invention, first briefly describing the drawings.

Drawings

Structure

Figure 1:
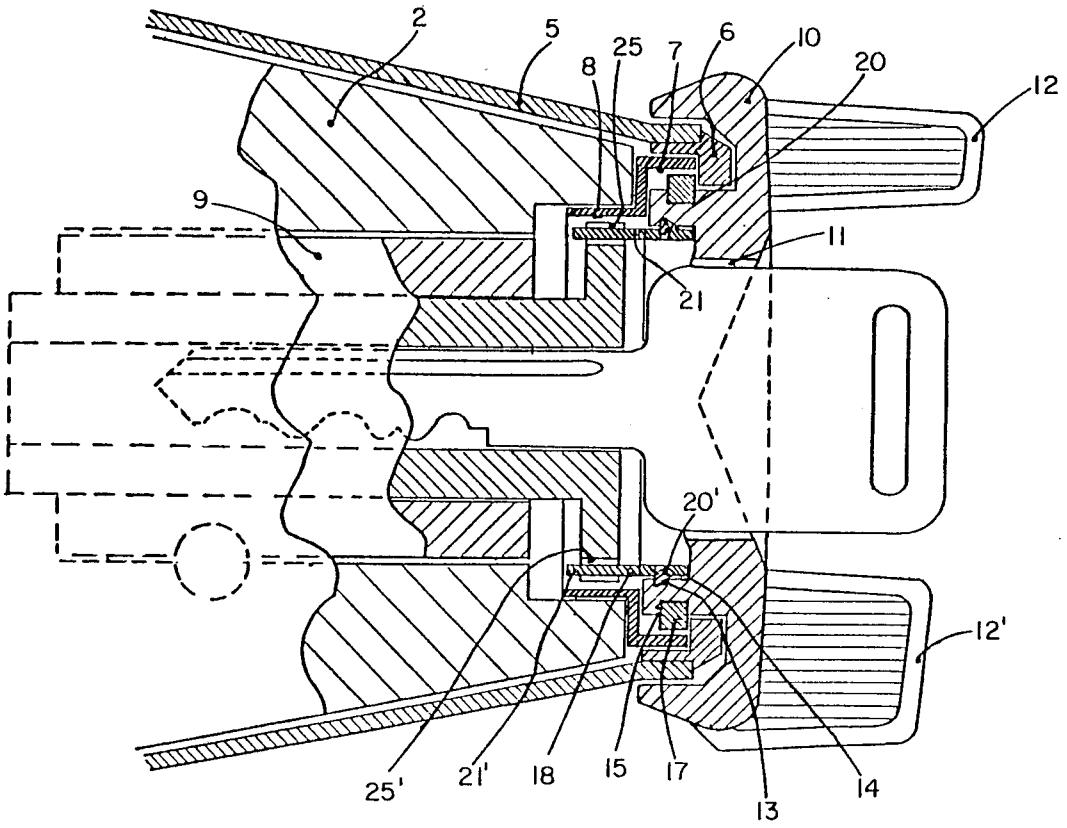
FIG. 1 is a side view partially in section of an ignition lock.
Figure 2:
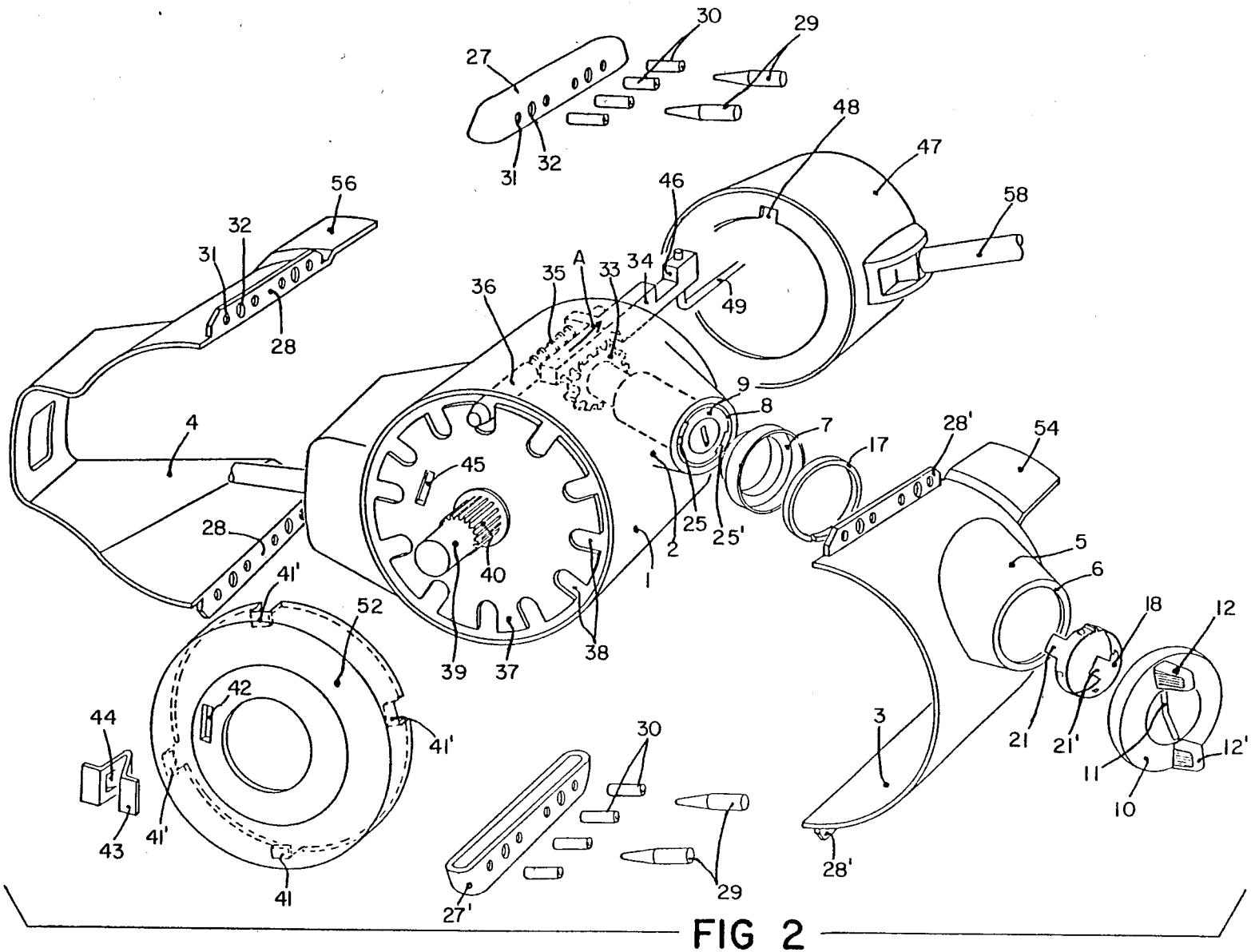
FIG. 2 is an exploded isometric view of a vehicle steering column with various theft protection devices according to the invention.

Referring to FIG. 1 and also to FIG. 2, ignition lock housing 1 with truncated conical housing protuberance 2 is surrounded by semicircular protective cowls 3, 4. Right cowl 3 has a truncated conical protruberance 5, corresponding to the housing protuberance 2, with an opening defined in the top surface by circular flange 6. Disposed axially in housing protuberance 2 is ignition lock cylinder 9. The annular inner end of alignment ring 7 is disposed in the annular gap 8 between the inner wall of the housing and the outer surface of the cylinder. The annular outer end of alignment ring 7 is coaxial with the inner end and contacts the inner surface of cowl protuberance 5 to align flange 6 coaxially with lock cylinder 9. Rotatable armor cap 10, having a slot 11 for receiving a key and actuating tabs 12, 12′ extending perpendicular to the cap surface, rotates coaxially with cylinder 9 on the surface of flange 6.

Figure 5:
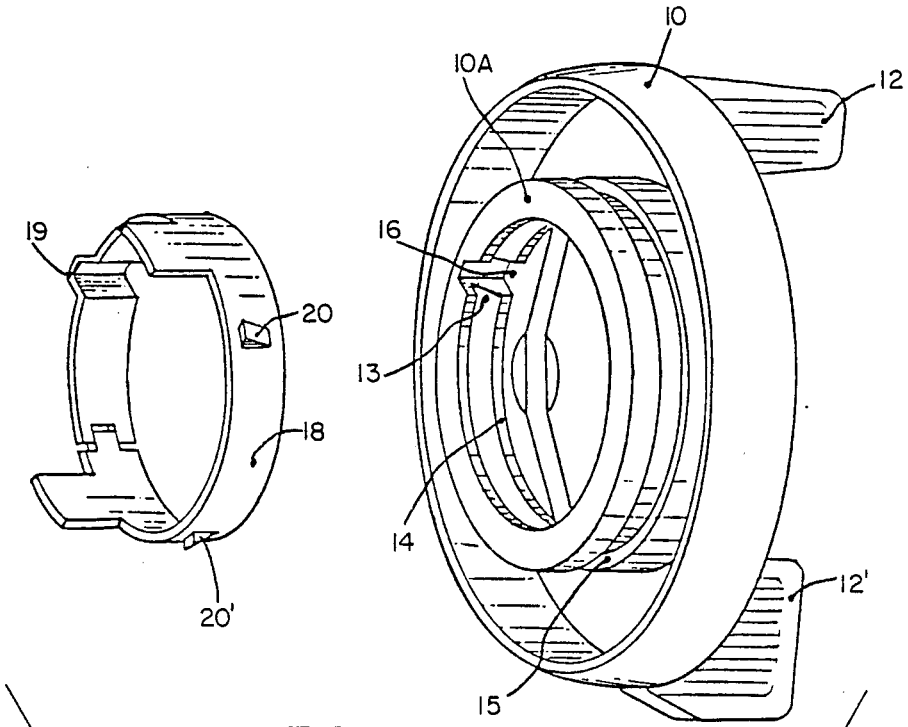
FIG. 5 is a similar view of the coupling in an exploded relationship with the ignition lock cap.
Figure 6:
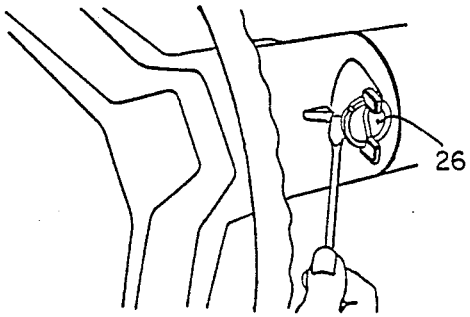
FIGS. 6 through 11 are sequential diagrammatic views of installation of the coupling, alignment means and cowling according to the invention.
Figure 7:
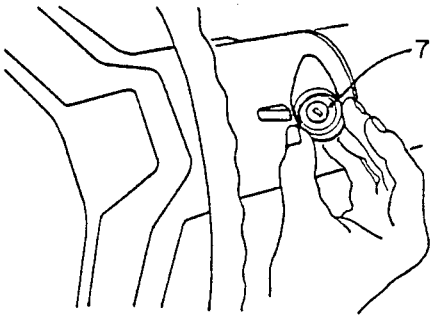
Figure 8:
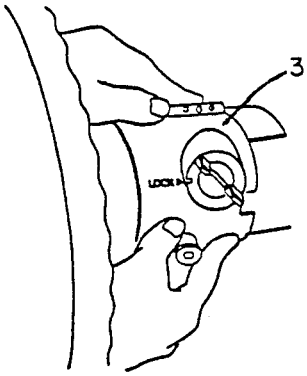
Figure 9:
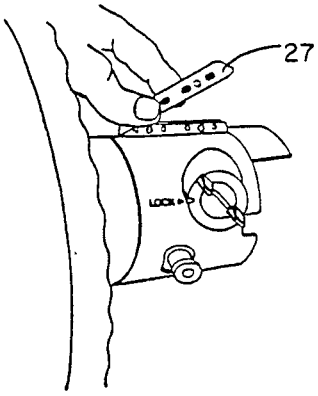

Referring to FIG. 5, inner annular protruberance 10*a* of cap 10 extending through the opening defined by flange 6 has an outer cylindrical surface and an inner cylindrical surface defining cylindrical recess 14. Defined in the inner surface is circumferential coupling groove 13 and tangential notch 16. Defined in the outer cylindrical surface of cap 10 is lock ring groove 15. Lock ring 17 engaged in groove 15 holds cap 10 in place in flange 6.

Figure 4:
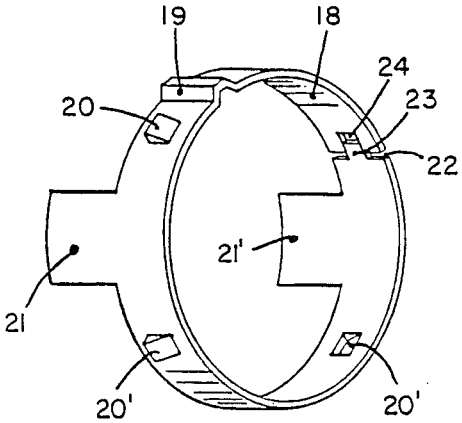
FIG. 4 is an isometric view of a torque-sensitive ignition lock coupling.

Referring also to FIG. 4, cylindrical spring coupling 18 has an annular surface with radially directed ridge 19 and detents 20, 20′. Extending axially from the body of coupling 18 are tabs 21, 21′. Coupling 18 in this preferred embodiment is formed of spring steel, e.g. about 0.030 inch thick. For ease of fabrication, coupling 18 is split at 22 forming dovetail projection 23 and corresponding notch 24. Coupling 18 is inserted into recess 14 of cap 10 with ridge 19 aligned in notch 16, and detents 20, 20′ engaged in groove 13. Tabs 21, 21′ engage in tangential slots 25, 25′, respectively, defined in lock cylinder 9.

Installation

Figure 3:
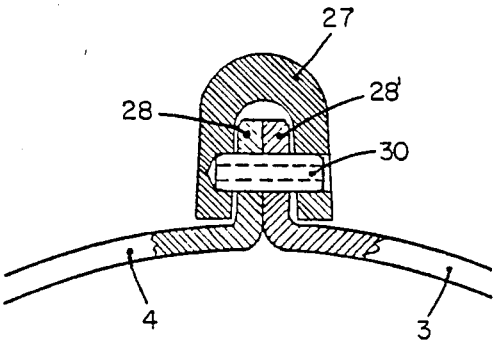
FIG. 3 is a section view of the clasp with a roll pin securing the protective cowling.
Figure 10:
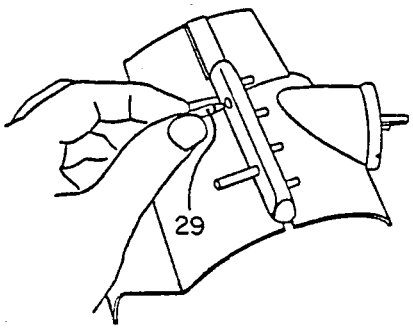
Figure 11:
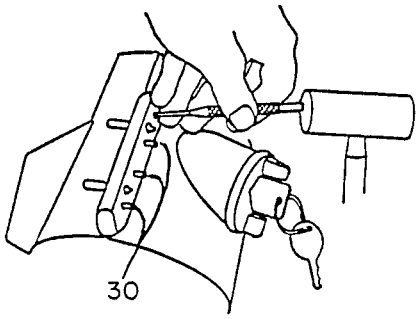

Referring now to FIGS. 6 through 11, and also to FIG. 2, the original equipment lock cylinder cap 26 is pried off and the inner end of alignment ring 7 is inserted into annular gap 8 between lock cylinder 9 and the inner surface of housing 2. The right cowl 3 is prepared as described above with armor cap 10 held in place within flange 6 by lock ring 17, and coupling 18 in place in cylindrical recess 14. As cowl protuberance 5 is placed over alignment ring 7, the outer annular portion aligns flange 6, and with it armor cap 10, coaxially with lock cylinder 9. When the cowl is in place, FIG. 9, the two halves are joined by clasps 27, 27′ tapped upon joined flanges 28, 28′, respectively. The clasps are held in place and aligned by drift pins 29, hammered into place in through-holes 32 (FIG. 10). Roll pins 30 are typically provided already in place in one side of clasp 27, 27′. At this point, the ignition, switches, etc., are tested before the cowl is secured. If everything is operative, the roll pins 30, sized to fit tightly into blind holes 31, are hammered into the holes (see FIG. 11) flush or slightly recessed from the clamp surface (see FIG. 3) to prevent tampering.

Operation

Referring to FIG. 2, to operate the vehicle, a key is inserted through slot 11 in cap 10 into lock cylinder 9. When the key is fully inserted as shown, the key may be turned with the cylinder and cap, typically using the additional leverage provided by actuating tabs 12, 12′.

Lock cylinder 9 will not rotate without the proper key. If the key is not fully inserted, or a key having the proper structure but incorrectly notched coding is fully inserted, cylinder 9 and cap 10 will not rotate. Tabs 21, 21′ of coupling 18 in lock cylinders slot 25, 25′ prevent the coupling from rotating and this restraint is transmitted via ridge 19 in notch 16 of cap 10 to prevent independent rotation of the cap. (In prior devices, the armor cap would rotate independently so the operator using hand leverage on the actuating tab could damage the key.)

The spring steel material of coupling 18 about ridge 19 is selected to resist deformation under torque up to a selected maximum, typically up to about the torque possible by hand. However, if abnormal force is applied, e.g. by a thief applying a wrench to actuating tabs 12, 12′ to force rotation of lock cylinder 9, ridge 19 will locally deform elastically allowing cap 10 to rotate independently with detents 20, 20′ in groove 13 thus foiling the thief.

When cap 10 is rotated to align ridge 18 once again in with notch 16, the elastic characteristic of coupling 18 causes it to return to original form for normal operation, without requiring repairs.

OTHER EMBODIMENTS

Other embodiments of the invention are within the following claims, for example, the physical structures described are for use with particular models of vehicles, other structures are envisioned to apply the invention to other vehicle models. Also a solid coupling ring could be employed, without the dovetail split, or a ring of oval or other shape could be employed.

OTHER INVENTIONS

Referring to FIG. 2, a typical vehicle ignition lock is shown in housing 1 adajcent to gear shift housing 42. Tangential to housing 1 is conical housing protuberance 2 containing lock cylinder 9. Cone 2 is truncated to expose the end of cylinder 9 for insertion of an ignition key. The typical method of bypassing the ignition lock system is to remove this cylinder, however if this avenue is blocked, e.g. by the cap and torque-sensitive coupling combination described above, other vulnerable points of the lock system may be attacked.

Further describing the typical ignition lock system, at the inner end of lock cylinder 9 is pinion 33 which is engaged in rack 34. When the vehicle is secured, pinion 33 fixes the position of rack 34. Dead bolt 36 is urged axially by spring 35 into the notches 38 of lock plate 37 which is secured by splines 40 to steering axle 39. This fixes the steering wheel against turning. (If the steering wheel is not positioned for proper alignment of dead bolt 36 with one of notches 38, the bolt remains tensioned against the under surface of plate 37 until the steering wheel is turned slightly, then spring 35 urges deadbolt 36 into notch 38 to lock the steering wheel.) Also, in the secured position, the opposed end 46 of rack 34 engages in notch 48 of gear shift housing 47 to prevent movement of the gear lever. When the proper key is inserted, cylinder 9 turns, thus turning pinion 33 to move rack 34 downward (indicated by arrow A) to disengage dead bolt 36 from notch 38 of lock plate 37, disengage end 46 of rack 34 from notch 48 of gear shift housing 47, and also move ignition switch activation rod 49 to start the vehicle.

A device, i.e. protective shields 3, 4, and 52, as is for protecting all of these points vulnerable to tampering by a thief which effectively shield and armor vulnerable areas of the vehicle ignition against tampering and provide sufficient deterent to discourage most vehicle thieves, are now more fully described. Shield 3, 4 covers tightly the ignition lock housing 1 and have extension 54, 56 which extends beyond the ignition lock housing to cover an adjacent portion of the gear shift housing 47 and the intervening gap. Extension 54, 56 is configured circumferentially to allow full movement of gear shift lever 58, and is also contoured radially away from housing 47 to prevent scraping when the gear shift lever is moved. Steering-lock-plate shield 52 covers steering lock plate 37. Tabs 41, 41' fit through notches 38 as the shield is installed and extend behind plate 37 when the shield is rotated a few degrees. The shield is secured by spring clip 43 inserted in the holes 42, 45 provided. The clip is held in place by detent 44 which engages on the back surface of the lock plate to prevent removal.

A potential thief, if unsuccessful at attempts to bypass the ignition lock system by removing the lock cylinder, probably the most vulnerable point of the system and thus the most preferred point of attack by thieves (indicated by I in the figures), e.g. when confronted by a vehicle with the armored cap and torque-sensitive coupling of the invention securing the ignition lock against removal from the housing, will typically turn to other popular methods of bypassing the ignition lock system. Other of these vulnerable points (also indicated in the figures) incude: driving the dead bolt axially out of position (II); dislodging the gear shift interlock or rack by prying between the ignition lock housing and the gear shift housing (III); or "peeling" the housing to gain access to the lock mechanism (IV). The described shields in combination with the cap and torque-sensitive coupling impede each of these approaches and in the case of a typical vehicle thief who relies on speed of operation and who will generally move to an unprotected vehicle if confronted with relatively effective protective devices, this is sufficient to prevent theft of vehicles protected according to the invention.

The use of shields 3, 4, 52 with cap 18 and coupling 18 secures all the other vulnerable areas of a vehicle ignition lock mechanism. Shield 52 prevents a thief from driving dead bolt 36 out of position to strip pinion 33 and/or disengage rack 34 and thus bypass the ignition lock to activate ignition switch rod 49. Extension 52, 56 of shields 3, 4 prevents access to the narrow, typically 1/16 to ⅛ inch, gap between the ignition lock housing 1 and the gear shift housing 47 into which a thief can insert a prying tool to widen the gap and provide access to the underlying end 46 of rack 34 and ignition switch activation rod 49. It also denies attempts to gain access by breaking through the gear shift housing.

The described devices, which are easily installed in a vehicle, effectively armor and protect the entire ignition lock system, including the ignition lock housing and adjacent vulnerable areas of the ignition system, to prevent the thief from gaining access to the ignition lock mechanism.

What is claimed is:

1. In a protective device for an ignition lock system of a motorized vehicle of the type in which an ignition lock housing extends about a steering column, and an ignition lock cylinder is at one side of the housing, said protective device comprising an armored cap arranged axially with and covering the end of said cylinder, and means providing a bearing surface for said cap, said cylinder and cap adapted for mutual rotation about the axis of the cylinder to activate the vehicle ignition when a mating key is fully inserted through said cap into said cylinder, said cap adapted to be rotated by hand to rotate said cylinder, and a protective cowl comprising at least two opposed shield elements constructed and arranged to be fixedly disposed about the ignition lock housing and, when assembled, sized to closely surround the housing, said cowl sized and constructed to protect the ignition lock cylinder to prevent unauthorized access thereto by car thieves, The Improvement Wherein said protective cowl further comprises a conical protrusion extending about said housing and terminating in said rotatable cap bearing surface adjacent the end of said cylinder, and said protective device comprises a torque-sensitive coupling means adapted to be disposed in coupling relationship between said lock cylinder and said cap, said coupling means constructed and arranged to transmit torque applied to said cap to said lock cylinder where said torque is of a value below a predetermined maximum value selected to exceed normal torque applied to an unlocked cylinder by a hand action of a vehicle operator, said maximum torque value being less than that needed to force rotation of said cylinder when said cylinder is still locked, said coupling means being adapted to disengage between said cap and said cylinder when torque above said predetermined maximum value is applied to said cap, whereby said cap and said cylinder are positively related to prevent independent rotation of either during normal operation, e.g. to avoid damage to a key that has been only partially inserted into said cylinder, said cap being free to turn in uncoupled relationship with said cylinder when abnormal torque is applied to the cap, thereby to prevent rotation of the cylinder by force of a car thief.

2. The protective device of claim 1 wherein said coupling means is a sleeve member having a radially extending protuberance, and a surface of said cap defines a complementary protuberance, said corresponding protuberances being engaged to provide coupled rotation during normal operation, and during application of torque in excess of said predetermined maximum value the protuberances being adapted to disengage thereby to permit relative motion between said coupling and said cap.

3. The protective device of claim 2 wherein said coupling means is adapted to deform about said protuberance under torque exceeding said maximum value to disengage said coupling means from said cap.

4. The protective device of claim 1 wherein said conical protrusion is an integral portion of at least a part of said protective cowl disposed about said housing.

5. The protective device of claim 1 wherein said device further comprises alignment means for fixedly aligning and maintaining the coaxial relationship of said cylinder and said cap, said alignment means constructed and arranged to position said bearing surface in a coaxial relationship with said cylinder.

6. The protective device of claim 5 wherein said alignment means comprises at least one tab element extending axially from said sleeve member, and said lock cylinder defines a complementary aperture, the engagement of said tab element in said aperture providing a secure coaxial relationship of said coupling means and said cap with said lock cylinder.

7. In a protective device for an ignition lock system of a motorized vehicle of the type in which an ignition lock housing extends about a steering column, and an ignition lock cylinder is at one side of the housing, said protective device comprising an armored cap arranged axially with and covering the end of said cylinder, and means providing a bearing surface for said cap, said cylinder and cap adapted for mutual rotation about the axis of the cylinder to activate the vehicle ignition when a mating key is fully inserted through said cap into said cylinder, said cap adapted to be rotated by hand to rotate said cylinder, and a protective cowl comprising at least two opposed shield element constructed and arranged to be fixedly disposed about the ignition lock housing and, when assembled, sized to closely surround the housing, said cowl sized and constructed to protect the ignition lock cylinder to prevent unauthorized access thereto by car thieves, The Improvement Wherein said protective cowl further comprises a conical protrusion extending about said housing and terminating in said rotatable cap bearing surface adjacent the end of said cylinder, and said protective device comprises a torque-sensitive coupling means adapted to be disposed in coupling relationship between said lock cylinder and said cap, said coupling means comprising a member having a protuberance, a surface of said cap defining a complementary protuberance, and alignment means for fixedly aligning and maintaining the coaxial relationship of said cylinder and said cap, said alignment means comprising at least one tab element extending axially from said sleeve member, and said lock cylinder defining a complementary aperture, said coupling means constructed and arranged to transmit torque applied to said cap to said lock cylinder where said torque is of a value below a predetermined maximum value selected to exceed normal torque applied to an unlocked cylinder by a hand action of a vehicle operator, said maximum torque value being less than that needed to force rotation of said cylinder when said cylinder is still locked, said coupling means being adapted to disengage between said cap and said cylinder when torque above said predetermined maximum value is applied to said cap, whereby said cap and said cylinder are positively related to prevent independent rotation of either during normal operation, e.g. to avoid damage to a key that has been only partially inserted into said cylinder, said cap being free to turn in uncoupled relationship with said cylinder when abnormal torque is applied to the cap, thereby to prevent rotation of the cylinder by force of a car thief.

* * * * *

UNITED STATES PATENT AND TRADEMARK OFFICE

CERTIFICATE OF CORRECTION

PATENT NO. : 4,559,795
DATED : December 24, 1985
INVENTOR(S) : Dimiter S. Zagoroff It is certified that error appears in the above-identified patent and that said Letters Patent are hereby corrected as shown below:

Title page:

In the References Cited: "3,916,568" should be --3,916,658--.

Signed and Sealed this

*Eighteenth* Day of *March 1986*

[SEAL]

*Attest:*

DONALD J. QUIGG

*Attesting Officer*

*Commissioner of Patents and Trademarks*